United States Patent [19]

Matsumoto et al.

[11] Patent Number: 4,951,090

[45] Date of Patent: Aug. 21, 1990

[54] HANDLE FOR PORTABLE COPYING MACHINE

[75] Inventors: Manabu Matsumoto; Takahiro Fukunaga, both of Nara, Japan

[73] Assignee: Sharp Kabushiki Kaisha, Osaka, Japan

[21] Appl. No.: 352,751

[22] Filed: May 16, 1989

[30] Foreign Application Priority Data

May 31, 1988 [JP] Japan ..... 63-135315

[51] Int. Cl.[5] ..... G03G 15/00

[52] U.S. Cl. ..... 355/200; 355/21; 355/202

[58] Field of Search ..... 355/200, 202, 21, 308, 355/316; 294/139

[56] References Cited

U.S. PATENT DOCUMENTS 4,456,362 6/1984 Masaki et al. ..... 355/21 X
4,635,010 1/1987 Miyai et al. ..... 355/200
4,705,384 11/1987 Mizutani et al. ..... 355/200
4,783,678 11/1988 Honda et al. ..... 355/308
4,789,876 12/1988 Miyai et al. ..... 355/200

FOREIGN PATENT DOCUMENTS 61-22915 9/1986 Japan .

*Primary Examiner*—A. C. Prescott
*Attorney, Agent, or Firm*—Irell & Manella

[57] ABSTRACT

A copying machine comprising a handle on one side of the body of the copying machine, said handle being made usable when a paper feed tray is removed from said copying machine body; a paper feed tray sensor which is activated when said paper feed tray is mounted onto said copying machine body; a jam sensor; and a means for detecting the occurrence of a jam only when said jam sensor and said paper feed tray sensor are both activated, thereby preventing malfunctioning of a jam sensor and saving the user unnecessary trouble.

4 Claims, 4 Drawing Sheets

HANDLE FOR PORTABLE COPYING MACHINE

BACKGROUND OF THE INVENTION

1. Field of the invention:

This invention relates to an improved copying machine capable of being carried and stored in an upright posture.

2. Description of the prior art:

Copying machines generally in use have a jam sensor in the paper transport path thereof to detect paper jam. Such a jam sensor is provided with an actuator easily rotatable by a slight force such as the pressure of copy paper, the activation of the jam sensor being detected when the actuator has remained in a depressed state for more than a fixed period of time (the time needed for the passage of copy paper therethrough).

On the other hand, with the recent popularization of copying machines, compact and portable copying machines have become available on the market. Such copying machines are so designed that they can be carried and stored in an upright posture. However, because powder-like toner is used in electrophotographic copying machines, toner may gather to one particular side in the developer unit or waste toner may leak, depending on the carrying or storing posture. To remove these problems, copying machines must be so designed that the developer unit will be kept in a horizontal position along its axial direction and that the waste toner box will not be turned over.

FIG. 4 is a side view of a conventional copying machine, in which a drumlike photoconductor 51 is disposed between the sidewalls of the machine roughly parallel to the end panels in the center of the body of the copying machine. Along the axial direction of the photoconductor 51, are disposed a developer unit 52 on the right side and a cleaning unit 53 containing a waste toner box on the left side. A paper feed system 54 including a paper feed tray 540 is disposed on the right side of the copying machine, and a paper exit system 55 on the left side thereof. When the copying machine is put on end with the handle 56 facing upward, the toner in the developer unit 52 does not gather to one side or the waste toner in the cleaning unit 53 does not leak. Therefore, a handle 56 is provided on the right side of the copying machine so that the copying machine will be put on end with the handle side facing upward.

However, since a jam sensor is installed in the copying machine as previously mentioned, when the copying machine is put on end with the right side of FIG. 4 (the side on which the paper feed system 54 is provided) facing upward, the actuator of the jam sensor is rotated, causing the activation of the jam sensor to be detected even when no jam has occurred. Once the activation of the jam sensor is detected, a jam release switch must be operated, which is inconvenient for the operator.

SUMMARY OF THE INVENTION

The copying machine of this invention, which overcomes the above-discussed and numerous other disadvantages and deficiencies of the prior art, comprises a handle on one end of the body of the copying machine, said handle being made usable when a paper feed tray is removed from said copying machine body; a paper feed tray sensor which is activated when said paper feed tray is mounted onto said copying machine body; a jam sensor; and a means for detecting the occurrence of a jam only when said jam sensor and said paper feed tray sensor are both activated.

In a preferred embodiment, the paper feed tray sensor is a microswitch which is activated by the mounting of the paper feed tray onto the body of the copying machine.

In a preferred embodiment, the jam sensor is a microswitch which is disposed in the vicinity of a paper exit roller in the paper exit path. The jam sensor has an activator which is rotatable when pressed by paper to be discharged to the outside of the body of the copying machine.

The handle is used to carry or store the copying machine in an upright posture. The handle is made usable when the paper feed try is removed from the body of the copying machine. This means that the paper feed tray sensor is in a deactivated state when the handle is in use.

With this invention, when the copying machine is put in an upright posture using the handle, since the paper feed tray sensor is in a de-activated state, it will not be determined that a jam has occurred even though the jam sensor is activated. On the other hand, when the paper feed tray is mounted on the copying machine with the handle not in use, since the paper feed tray sensor is in an activated state, it will be determined that a jam has occurred when the jam sensor is activated.

Thus, the invention described herein makes possible the objectives of (1) providing a copying machine which prevents malfunctioning of a jam sensor, thus saving the user unnecessary trouble; and (2) providing a copying machine in which occurrence of a jam is not determined when the jam sensor is activated because of upright positioning of the copying machine, thereby saving the trouble of operating the release switch on startup when a jam has not actually occurred, and enhancing the serviceability to the user.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1A:
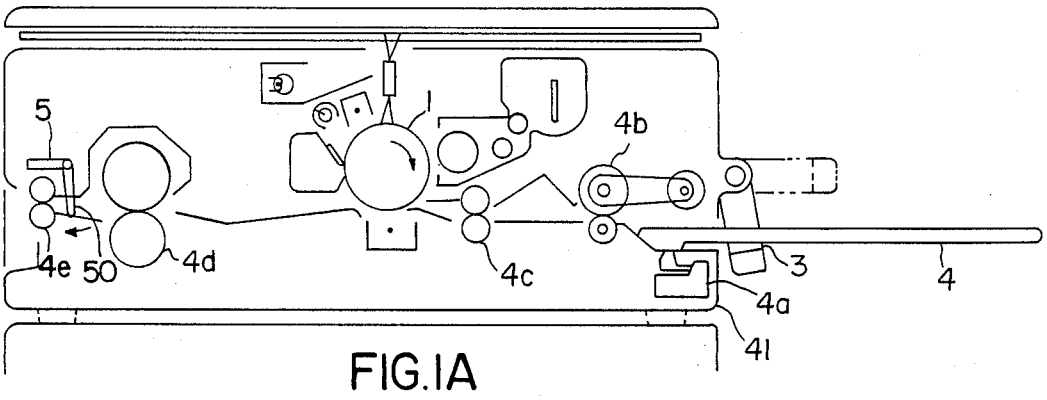
FIG. 1A is a front view showing the body of a copying machine with a paper feed tray of this invention.
Figure 1B:
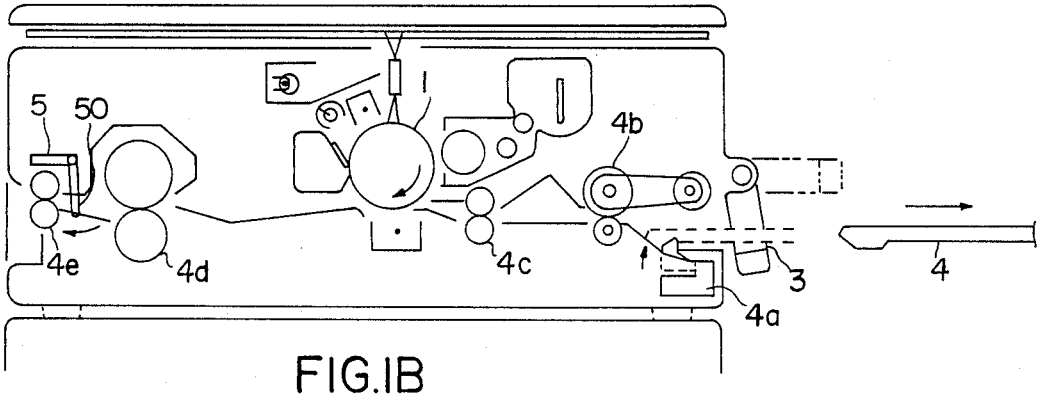
FIG. 1B is a front view showing a copying machine without a paper feed tray of this invention.
Figure 1C:
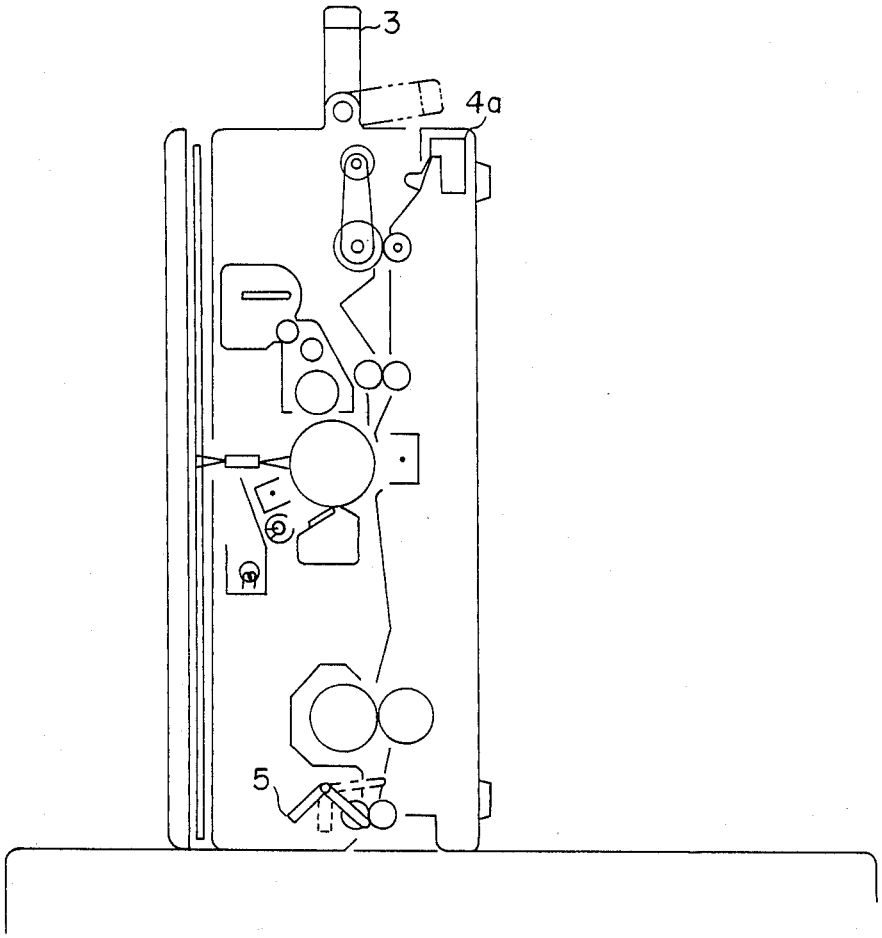
FIG. 1C is a front view showing the copying machine of FIG. 1B that is in an upright posture.

FIGS. 1A–1C show a copying machine of this invention, which comprises a drum shaped photoconductor 1 that is mounted rotatably in the direction of the arrow shown in FIGS. 1A and 1B in the approximately middle part of the body of the copying machine. Around the photoconductor 1, a process unit comprising a charge corona, a photofocusing transmitter, a developer unit, etc., are disposed. On the right side of the body of the copying machine are provided a handle 3 and a paper feed tray 4.

Figure 2:
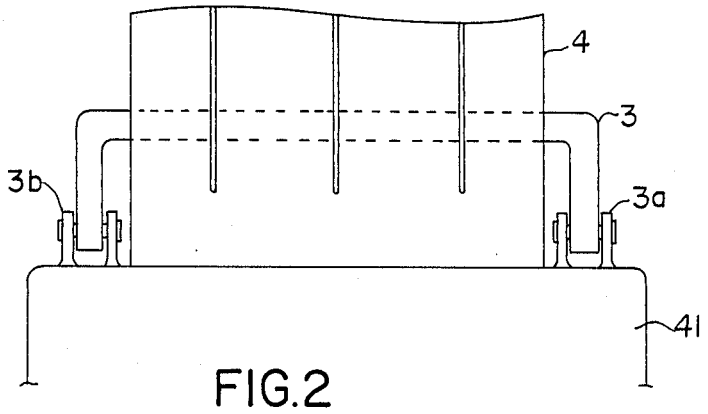
FIG. 2 is a top view showing a paper feed system that is the part of the copying machine of FIG. 1A.
Figure 4:
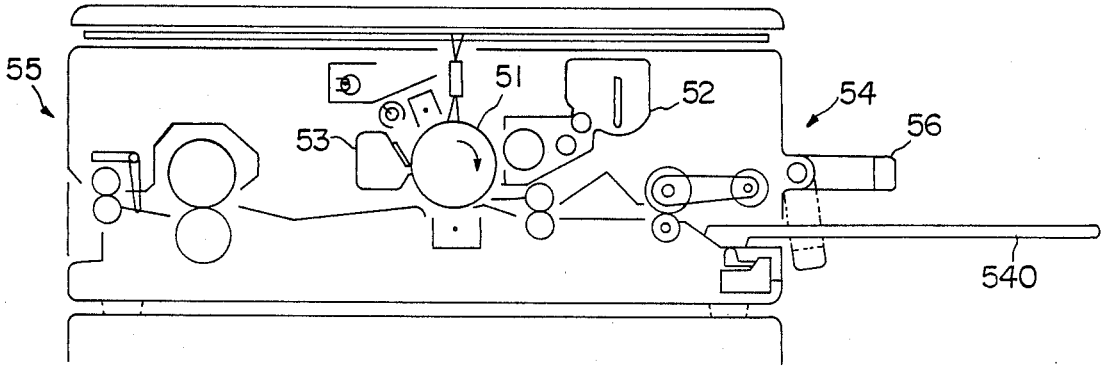
FIG. 4 is a front view showing a conventional copying machine.

On the rear and front sides of the body of the copying machine are formed mounting brackets 3*a* and 3*b* (FIG. 2) to which the handle 3 is rotatably mounted. Inwardly of the mounting brackets 3*a* and 3*b*, the paper feed tray 4 is detachably provided. The handle 3 is disposed above the mounting section 41 of the paper feed tray 4. When the handle 3 is in an upright position (in a usable position), even though the paper feed tray 4 is mounted, the handle 3 interferes with paper feed operation. The handle 3 must therefore be placed in a flattened position (in a non-usable position) when the paper feed tray 4 is mounted. In the mounting section 41 of the paper feed tray 4 is provided with a paper feed tray sensor 4*a*. The paper feed tray sensor 4*a* that is formed, for example, of a microswitch is activated when the paper feed tray 4 is mounted.

Paper in the paper feed tray 4 is fed into the body of the copying machine by a paper feed roller 4*b*, is transported by a resist roller 4*c*, the transfer section of the photoconductor 1, a heat roller 4*d* and a paper exit roller 4*e*, and is discharged from the left side of the body of the copying machine. To detect a jam in the paper transport path, a jam sensor 5 is provided upstream of the paper exit roller 4*e*. The jam sensor 5 is formed of a microswitch the actuator 50 of which is rotatable in the direction of the arrow shown in the FIGS. 1A and 1B when pressed by the paper.

The handle 3 is used when the copying machine is carried or stored in an upright posture. When the handle 3 is in use, the paper feed tray 4 must be removed, which means that the paper feed tray sensor 4*a* is put in a deactivated state when the paper feed tray 4 is not mounted. On the other hand, when the copying machine is put in an upright posture, the actuator 50 of the jam sensor 5 is rotated and remains in a rotated state for more than a fixed period of time, causing the activation of the jam sensor to be detected.

Figure 3:
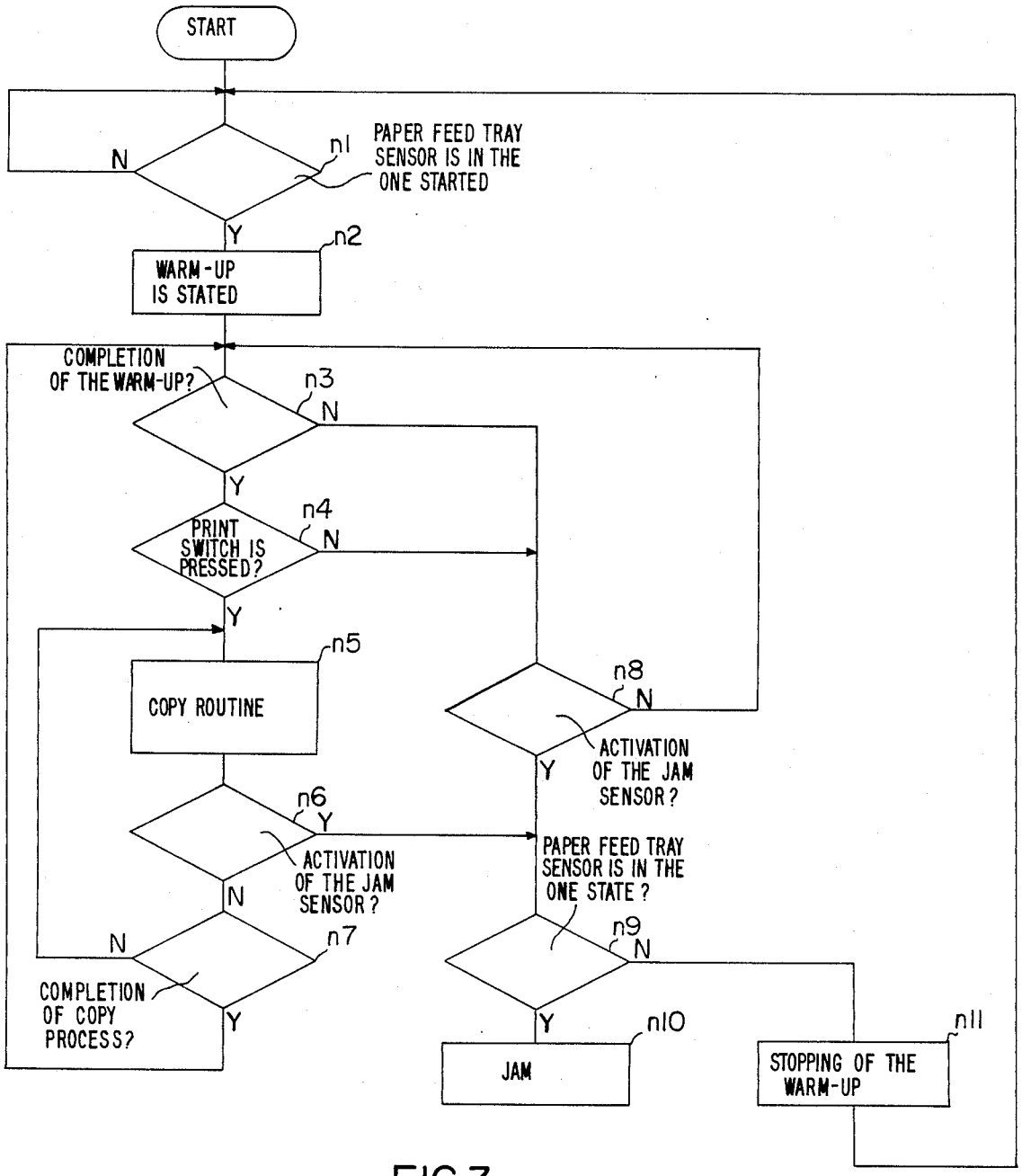
FIG. 3 is a flow chart showing the program of the operation process of a copying machine of this invention.

FIG. 3 shows a flow chart showing the program of an operation process of the above-mentioned copying machine of this invention. When power is turned on to the copying machine, the on/off state of the paper feed tray sensor 4*a* (presence and absence of the paper feed tray) is checked in step n1. If the paper feed tray 4 is mounted, the operation proceeds to step n2 to start warm-up. That is, if the paper feed tray 4 is mounted, warm-up is automatically started without requiring the operator to perform any complicated operations. After completion of the warmup (n3), when the print switch for starting the copy process is pressed (n4), the copy routine proceeds (n5, n7), but when the activation of the jam sensor is detected during the copy process (n6), the operation branches to step n9 Also, when the activation of the jam sensor 5 is detected during the warm-up or after completion of the warm-up and before depression of the print switch (n8), the operation proceeds to step n9. In step n9, the on/off state of the paper feed tray sensor 4*a* is checked. If the paper feed tray sensor 4*a* is in an activated state at this time, it is determined that the activation of the jam sensor 5 is the result of a jam, and the operation proceeds to n10 for processing of the jam. On the other hand, if the paper feed tray sensor 4*a* is in a deactivated state, it is determined that the jam sensor 5 has been activated because the copying machine is put in an upright posture, stopping the warming up operation (n11) and waiting till the paper feed tray 4 is mounted (n1).

The means of this invention for detecting the occurrence of a jam only when the jam sensor and the paper feed tray sensor are both activated corresponds to the steps n6, n8, n9 and n10.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art &:o which this invention pertains.

What is claimed is:

1. A copying machine comprising a handle on one end of the body of the copying machine, said handle being made usable when a paper feed tray is removed from said copying machine body; a paper feed tray sensor which is activated when said paper feed tray is mounted onto said copying machine body; a jam sensor; and a means for detecting the occurrence of a jam only when said jam sensor and said paper feed tray sensor are both activated.

2. A copying machine according to claim 1, wherein said paper feed tray sensor is a microswitch which is activated by the mounting of the paper feed tray onto the body of the copying machine.

3. A copying machine according to claim 1, wherein said jam sensor is a microswitch which is disposed in the vicinity of a paper exit roller in the paper exit path.

4. A copying machine according to claim 3, wherein said jam sensor has an activator which is rotatable when pressed by paper to be discharged to the outside of the body of the copying machine.

* * * * *